United States Patent [19]

Wada et al.

[11] 4,235,194

[45] Nov. 25, 1980

[54] DRY PROCESS DEVELOPING APPARATUS FOR USE IN ELECTROPHOTOGRAPHIC COPYING MACHINE

[75] Inventors: Kenichi Wada; Susumu Tanaka, both of Sakai; Yoshihiro Isono, Itami; Kenji Tabuchi, Sakai; Tateki Oka, Sakai; Hiroaki Mizunoe, Sakai, all of Japan

[73] Assignee: Minolta Camera Kabushiki Kaisha, Osaka, Japan

[21] Appl. No.: 16,610

[22] Filed: Mar. 1, 1979

[30] Foreign Application Priority Data

Mar. 9, 1978 [JP] Japan ..... 53-27295
Mar. 9, 1978 [JP] Japan ..... 53-27296
Mar. 24, 1978 [JP] Japan ..... 53-34719

[51] Int. Cl.[3] ..... G03G 15/09

[52] U.S. Cl. ..... 118/657; 222/DIG. 1; 355/3 DD

[58] Field of Search ..... 427/18; 118/657, 658; 222/DIG. 1; 430/122; 355/3 DD

[56] References Cited

U.S. PATENT DOCUMENTS 3,152,924 10/1964 Wanielista et al. ..... 118/657
3,906,897 9/1975 Davidson ..... 118/637
3,926,516 12/1975 Whited ..... 355/3 DD
3,940,272 2/1976 Davidson ..... 427/18
4,113,371 9/1978 Fraser et al. ..... 222/DIG. 1

*Primary Examiner*—Evan K. Lawrence
*Attorney, Agent, or Firm*—Wenderoth, Lind & Ponack

[57] ABSTRACT

A dry process developing apparatus for use in an electrophotographic copying machine which includes a developing non-magnetizable sleeve and a multipolar magnet member arranged to be rotated in the same direction at different speeds, the speed of rotation of the developing sleeve causing movement of those particles of the developing material which at the most are only slightly affected by the multipolar magnet member in the direction of rotation of the sleeve, and the speed of rotation of the multipolar magnet causing the movement of particles of developing material affected by the magnet around the sleeve in a direction of rotation opposite that of the magnet and at a speed greater than the speed of the developing sleeve. Scraping members are provided for sliding contact with the peripheral surface of the developing sleeve in the directions against and following the direction of rotation of the developing sleeve.

4 Claims, 9 Drawing Figures

DRY PROCESS DEVELOPING APPARATUS FOR USE IN ELECTROPHOTOGRAPHIC COPYING MACHINE

BACKGROUND OF THE INVENTION

The present invention relates to electrophotography and more particularly, to a dry process developing apparatus for use in an electrophotographic copying machine.

Conventionally, for dry process developing employing developing materials containing magnetizable components, there has been proposed, for example, in Japanese Laid Open Patent Application Tokkaisho No. 52-17831, a developing apparatus of the rotatable outer cylinder or developing sleeve type in which a multipolar magnet member is fixedly disposed in a rotatable developing sleeve of non-magnetizable material and developing material transported onto the developing sleeve is formed into a magnetic brush on the peripheral surface of the developing sleeve, the amount being restricted by a doctor blade for developing an electrostatic latent image formed on a photosensitive member or photoreceptor into a visible image. There has also been proposed, in Japanese Laid Open Patent Application Tokkaisho No. 52-67336, a developing apparatus of the rotary magnet type in which the developing material is formed into the magnetic brush on the outer periphery of a fixed developing sleeve of non-magnetizable material by magnetic force from an alternating field produced by a rotary multipolar magnet member rotatably housed in the fixed outer sleeve for developing the electrostatic latent image formed on the photoreceptor by the magnetic brush thus formed.

However, since the developing materials employed in the known developing apparatuses as described above have extremely fine particles, such developing materials tend to be aggregated or collected into lumps due to moisture and electrostatic attraction between the particles of the developing material, and the developing material supplying port or doctor blade portion for regulating the amount of the developing material on the developing sleeve becomes clogged by these lumps, thereby obstructing smooth transfer of the developing material and resulting in disadvantages, for example, deterioration of the quality of the copied image due to fogging by the toner.

Meanwhile, owing to the fact that both of the conventional developing apparatuses, the rotatable developing sleeve type and the rotary magnet type, as described above are arranged to effect development by lightly rubbing the developing material in the shape of a magnetic brush formed on the developing sleeve against the electrostatic latent image on the photoreceptor, the density of the developed images is proportional to the speed of movement of the developing material over the developing sleeve. More specifically, in order to obtain sufficient density of the developed images, it is necessary that the developing material moving on the surface of the developing sleeve in the form of the magnetic brush rubs against the surface of the photoreceptor bearing the latent image formed thereon at a comparatively high speed. Although the speed of movement of the developing material is sufficiently high in the developing apparatus of the rotating developing sleeve type as described above, the developing material tends to be solidified due to compression between the developing sleeve and the photoreceptor, thus resulting in insufficient developing treatment. In the developing apparatus of the rotary magnet type in which the multipolar magnet member is rotated at a very high speed, eddy currents are produced on the developing sleeve, which is normally made of non-magnetizable electrically conductive material (for example, aluminum) through rotation of the multipolar magnet member disposed therein, with the phenomenon becoming conspicuous as the speed of rotation of the magnet member increases, giving rise to adverse effects such as temperature rise of the developing sleeve itself, increase of driving torque needed for rotating the multipolar magnet member, etc.

For improving the image density without rotating the developing sleeve or multipolar magnet member so as to eliminate the temperature rise, increase of the driving torque, etc. as described above, it has been suggested to increase the length of contact between the developing material and surface of the photoreceptor having the electrostatic latent image defined thereon by forming a developing material collecting zone as indicated at Q in FIG. 5 by feeding of a sufficient amount of developing material onto the developing sleeve. The arrangement as described above, however, still has a disadvantage in that there is produced a zone P in the developing material collecting zone Q at a position spaced somewhat from the developing sleeve 11 and which is not affected by the magnetic force of the multipolar magnet member 12, in which zone P, the developing material is solidified or remains stagnant so as to give rise to fogging and adversely affecting the quality of the copied images.

In the case where toner particles of an electrically insulating nature are employed for developing electrostatic latent images formed on the photoreceptor in electrophotographic copying machines in general, the machine is normally so arranged that the developing material including toner particles and magnetizable carrier particles is stirred for causing the toner particles and magnetizable carrier particles to uniformly contact each other, but in the conventional developing apparatuses, it has been rather difficult to fully stir the developing material completely due to deficiencies in the construction of such known developing apparatuses. For eliminating disadvantages in the conventional dry process two-component developing method and one component developing method, there has been proposed by the present inventors in Japanese Patent Application No. 158110/51 a novel dry method developing process which employs as developing material a mixture prepared by mixing magnetizable toner particles having average particle diameters of 3 to 30 $\mu$m and a resistivity of $10^3$ to $10^{16}$ $\Omega$.cm with electrically insulating non-magnetizable toner particles having average particle diameters of 3 to 30 $\mu$m at a mixing ratio of 1 to less than 2.5 by weight. While the known developing method as described above is advantageous in that the image quality is not caused to deteriorate by the variation of the mixing ratio of the two kinds of toner particles and facilitated fixing, sufficient stirring of the developing material cannot be effected by the conventional stirring devices, since the non-magnetizable toner particles and magnetizable toner particles are very fine and have an extremely small mass, thus resulting in uneven charging of the toner particles which causes deterioration of the copied images, and because of the small magnetic retaining force due to the extremely small particle diameters of the magnetizable toner particles, it has been difficult to properly feed the developing material onto the developing sleeve by magnetic force in the conventional developing apparatuses.

Furthermore, in a developing apparatus for causing the non-magnetizable toner and magnetizable toner to simultaneously adhere to the electrostatic latent image to be developed as described above, it is necessary to provide a developing material supplying device or toner dispenser capable of constantly replenishing the magnetizable toner as well as the non-magnetizable toner at a rate corresponding to the variation of the electrostatic charge pattern of the electrostatic latent images to be developed.

Conventionally, as a supplying device for the developing material of the above described kind, it has been proposed to use an arrangement wherein the developing material prepared by mixing the non-magnetizable toner particles with magnetizable toner particles at a predetermined ratio in a so-called premixed state is accommodated in a developing material supplying container for simultaneously supplying the non-magnetizable toner and magnetizable toner into the developing apparatus.

In the known arrangement as described above, however, the rate of consumption of the magnetizable toner and non-magnetizable toner is constantly varying due to variations of the electrostatic charge pattern in the actual developing. More specifically, it has been confirmed by the present inventors that in ordinary originals the pattern of which is mainly composed of letters, characters, etc. (so-called line copy), the ratio of the magnetizable toner $t_m$ to non-magnetizable toner $t_n$ consumed in the developing, which is represented by $(t_n/t_m+t_n)\times 100$ weight %, is approximately 85 weight %, while in originals having much larger area images including photographs and the like (so-called solid copy), the ratio is approximately 95 weight %. Therefore, when developing material prepared by pre-mixing the magnetizable toner and non-magnetizable toner, for example, at a ratio of 85 weight % is loaded in the known developing material supplying container as described above for feeding, if solid copy is continuously developed, the rate of use the magnetizable toner for the developing material in the developing apparatus tends to increase as compared with the initial setting (the rate of the non-magnetizable toner for the developing material in the developing apparatus is normally at 10 weight %), resulting in difference of image quality arising from variations of density between copied images, although no particular inconveniences are encountered in the line copy.

SUMMARY OF THE INVENTION

Accordingly, an essential object of the present invention is to provide a dry process developing apparatus for use in an electrophotographic copying machine in which undesirable temperature rise of the developing sleeve and increase of torque for driving the multipolar magnet member have been eliminated, while developing material on the developing sleeve which is little affected or not affected at all by the moving force due to the rotation of the multipolar magnet member is returned to a developing material storage tank to prevent adverse effects in the developed images, such as fogging by toner in the developing material.

Another important object of the present invention is to provide a dry process developing apparatus of the above described type which is capable of effectively storing, stirring and transporting not only the conventional two-component developing material, but also developing material prepared by mixing magnetizable toner and non-magnetizable toner as described in the foregoing.

A further object of the present invention is to provide a dry process developing apparatus of the above described type which is equipped with a developing material supplying device capable of simultaneously supplying the magnetizable toner and non-magnetizable toner at a rate corresponding to the variation of the electrostatic charge pattern of the electrostatic latent images to be developed.

A still further object of the present invention is to provide a dry process for developing apparatus of the above described type which has a simple construction and functions accurately, and which can be readily incorporated into various electrophotographic copying machines at low cost.

In accomplishing these and other objects, according to one preferred embodiment of the present invention, the dry process developing apparatus for use in an electrophotographic copying machine which includes a developing casing, a developing sleeve rotatably provided in the developing casing, and a multipolar magnet member also rotatably accommodated in said developing sleeve for developing an electrostatic latent image formed on an image bearing member into a visible image by bringing said electrostatic latent image into contact with developing material transported on the developing sleeve, further comprises means for driving said multipolar magnet member for rotation in the same direction as the rotation of said developing sleeve within said developing sleeve, and at least first and second scraper members in sliding contact with the surface of said developing sleeve. The developing sleeve and multipolar magnet member are driven in the same direction in such a manner that the speed of movement of the developing material which includes particles of small diameter at least containing a magnetizable component and which follows the rotation of said developing sleeve becomes lower than the speed of movement said developing material which follows the rotation of said multipolar magnetic member and the first scraper member is directed in a direction to scrape off the developing material adhering to the surface of the developing sleeve as said developing sleeve rotates and the second scraper member is directed in a direction to scrape off the developing material from the surface of said developing sleeve as the developing material moves on said developing sleeve.

By the arrangement of the present invention as described above, it has become possible to carry out favorable developing by sufficient stirring of the developing material on the developing sleeve as the developing sleeve rotates, with substantial elimination of the disadvantages inherent in the conventional developing apparatuses of this kind.

BRIEF DESCRIPTION OF THE DRAWINGS

These and other objects and features of the present invention will become apparent from the following description of preferred embodiments thereof taken in conjunction with the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
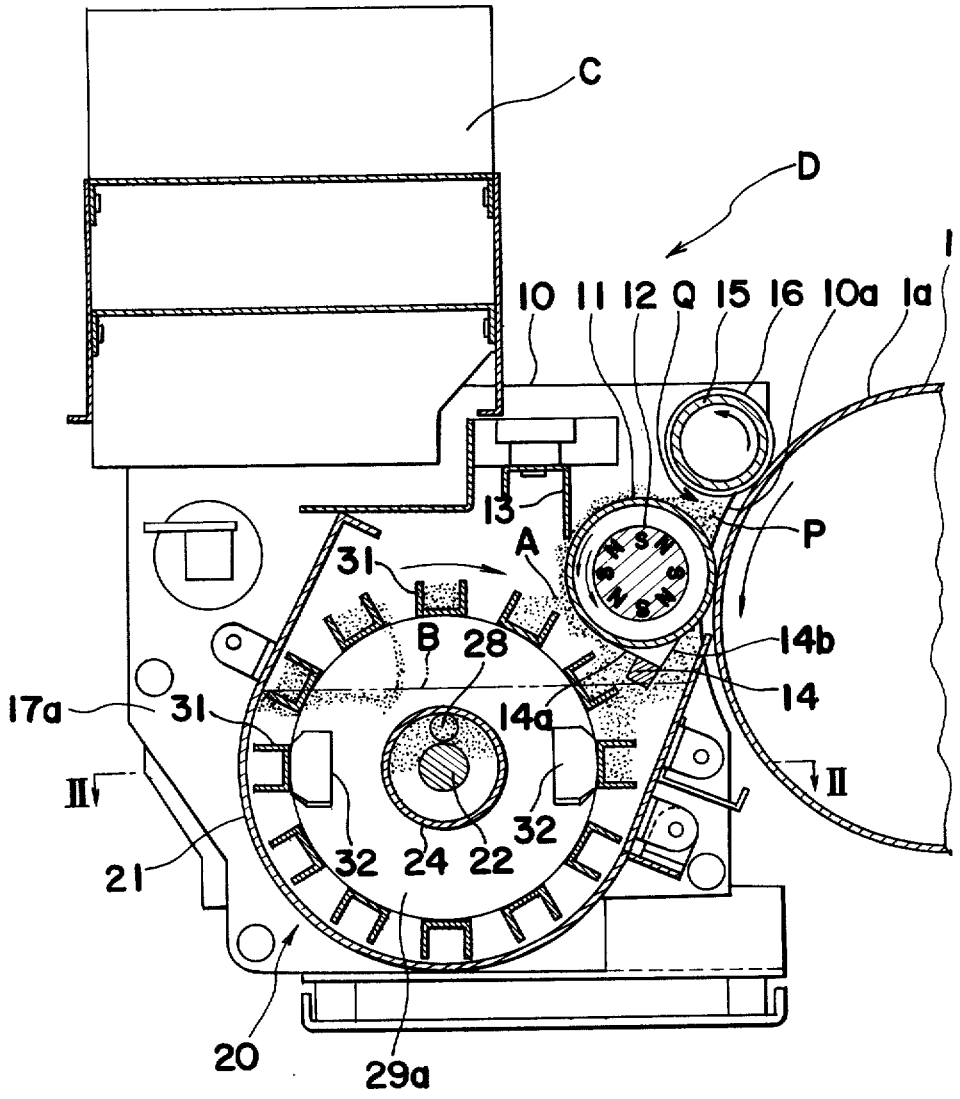
FIG. 1 is a schematic side sectional view of a dry process developing apparatus according to one preferred embodiment of the present invention.

Referring now to the drawings, there is shown in FIG. 1 a dry process developing apparatus D according to one preferred embodiment of the present invention, which generally includes a housing 10 extending the width of a known drum type photoreceptor 1 and substantially enclosed except for an opening 10*a* adjacent to the photosensitive or photoreceptor surface 1*a* of the photoreceptor 1 whereat the development of electrostatic latent images formed on the photoreceptor surface 1*a* is effected, an outer cylinder or developing sleeve 11 rotatably provided in the housing 10 adjacent to the photoreceptor surface 1*a*, a rotary magnet or multipolar magnet member 12 rotatably enclosed in the developing sleeve 11, a developing material stirring device 20 provided in the housing 10 under the developing roller 11, and a developing material supplying device or toner dispenser C disposed above the developing material stirring device 20 for supplying toner into the developing apparatus D in a known manner.

The developing sleeve 11 has a cylindrical configuration and is made of non-magnetizable electrically conductive material such as aluminum and is disposed for rotation counterclockwise at approximately 30 r.p.m. in a position close to the surface 1*a* of the photoreceptor 1 which is also capable of rotating counterclockwise. The multipolar magnet member 12 has a roll-like configuration with magnetic poles N and S sequentially arranged around its outer periphery at alternately different polar orientation as shown and has means connected to it to rotate it at a speed of 2000 r.p.m. in the same direction as the developing sleeve 11. More specifically, on the assumption that the developing sleeve 11 has a diameter of 31 mm, the developing material reaches a speed of movement of approximately 10 cm/sec. in the clockwise direction by rotation of the multipolar magnet member 12, and also a speed of movement of approximately 5 cm/sec. in the counterclockwise direction by rotation of the developing sleeve 11, and is consequently moved along the surface of the developing sleeve 11 at a speed of approximately 5 cm/sec. in the clockwise direction.

Meanwhile, at a lower portion of the developing sleeve 11, scraper members or scraping plate members 14*a* and 14*b* made of non-magnetizable resilient material, for example, suitable synthetic resin, thin metallic material, etc. are fixed to a support shaft 14 and are in sliding contact with the peripheral surface of the developing sleeve 11, one being directed opposite to and the other being directed in the same direction as the direction of rotation of the developing sleeve 1.

The developing material is successively transported to a position A whereat it is affected by the moving force arising from rotation of the multipolar magnet member 12, by trough-like members 31 provided around peripheral edges of rotary discs 29*a* and 29*b* of the developing material stirring device 20 described more in detail later, and from the position A, is moved along the surface of the developing sleeve 11 at the speed of approximately 5 cm/sec. in the clockwise direction, with the amount being restricted by a doctor blade 13 provided above and adjacent to the surface of the developing sleeve 11. After once being collected in the developing material collecting zone Q mentioned earlier and formed between the developing sleeve 11 and photoreceptor 1, the developing material is rubbed against the electrostatic latent image preliminarily formed on the photoreceptor surface 1*a* for developing the latent image.

It should be noted here that in the above case, since the developing material is subjected to the moving force and is disturbed owing to rotation of the developing sleeve 11 even in the zone P mentioned earlier which is spaced somewhat from the developing sleeve 11 in the developing material collecting zone Q, hardening or solidification of the developing material at the zone P is advantageously prevented, which is mainly attributable to the novel construction according to the present invention which is arranged so as to avoid compression of the developing material between the developing sleeve 11 and photoreceptor 1.

Meanwhile, impurities such as dust and dirt and the like mixed in the developing material, or toner particles, etc. solidified in the vicinity of the doctor blade 13, which are not affected or only slightly affected by the moving force arising from rotation of the multipolar magnet member 12, are moved following rotation of the developing sleeve 11 in a direction opposite to that of movement of the developing material, i.e. counterclockwise, and scraped off the developing sleeve 11 by the scraping plate member 14*a* directed in a direction opposite the direction of rotation of the developing sleeve 11. On the other hand, the developing material which remains on the sleeve 11 after the sleeve has rotated past the developing material collecting zone is scraped off the developing sleeve 11 by the scraping plate member 14*b* directed in the same direction as the direction of rotation of the developing sleeve 11 for being returned to a developing material storage tank 21 of the developing material stirring device 20.

Still referring to FIG. 1, in a position above developing sleeve 11 is provided a rotatable roll 15, with a slight clearance being maintained between the roll 15 and the surface 1*a* of the photoreceptor 1 for preventing dust of toner particles from entering the interior of the copying machine (not shown). The roll 15 is provided, at opposite ends thereof, with rollers 16 each having a diameter slightly larger than that of the roll 15 and contacting corresponding ends of the photoreceptor drum 1 for simultaneous rotation with the photoreceptor 1 and also for proper positioning of the developing sleeve 11 with respect to the photoreceptor drum 1.

Figure 2:
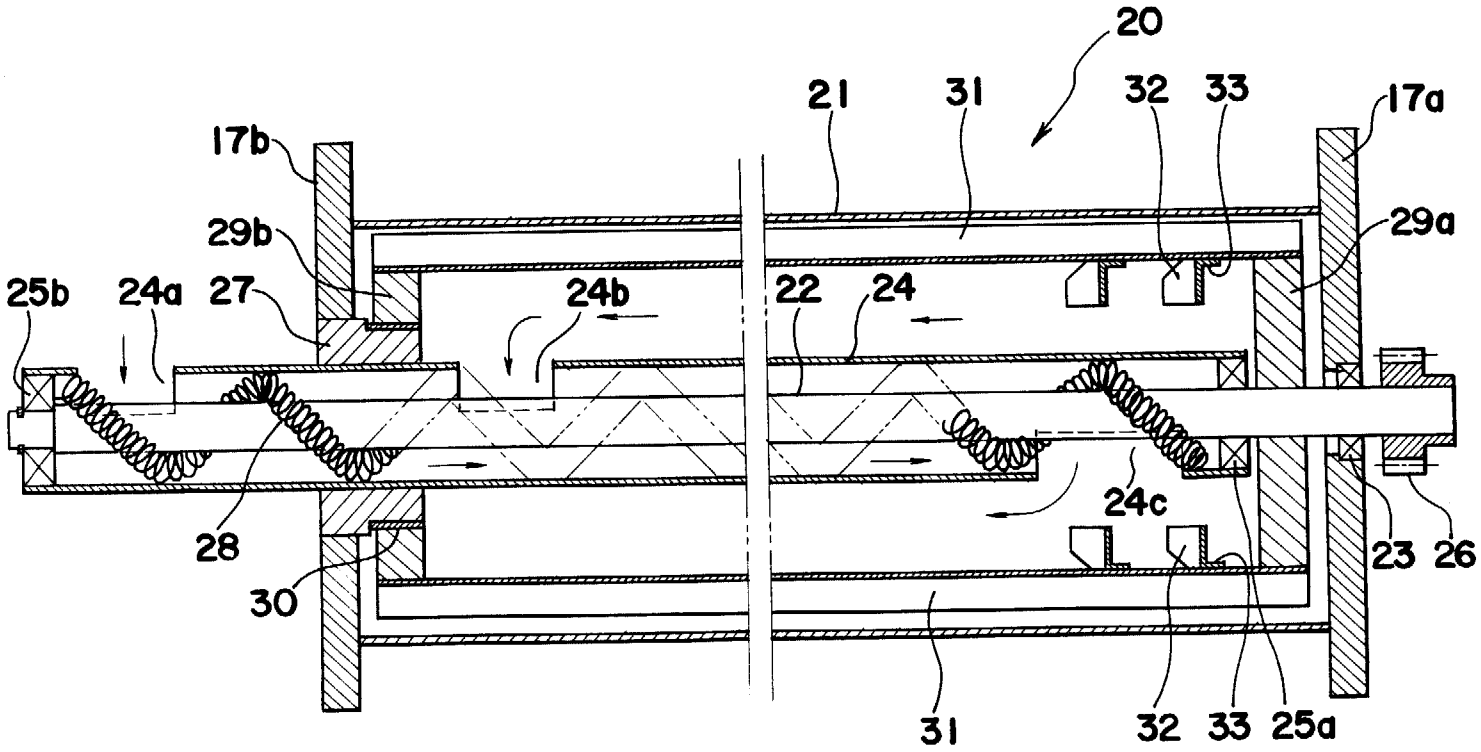
FIG. 2 is a sectional view taken along the line II—II of FIG. 1.
Figure 3:
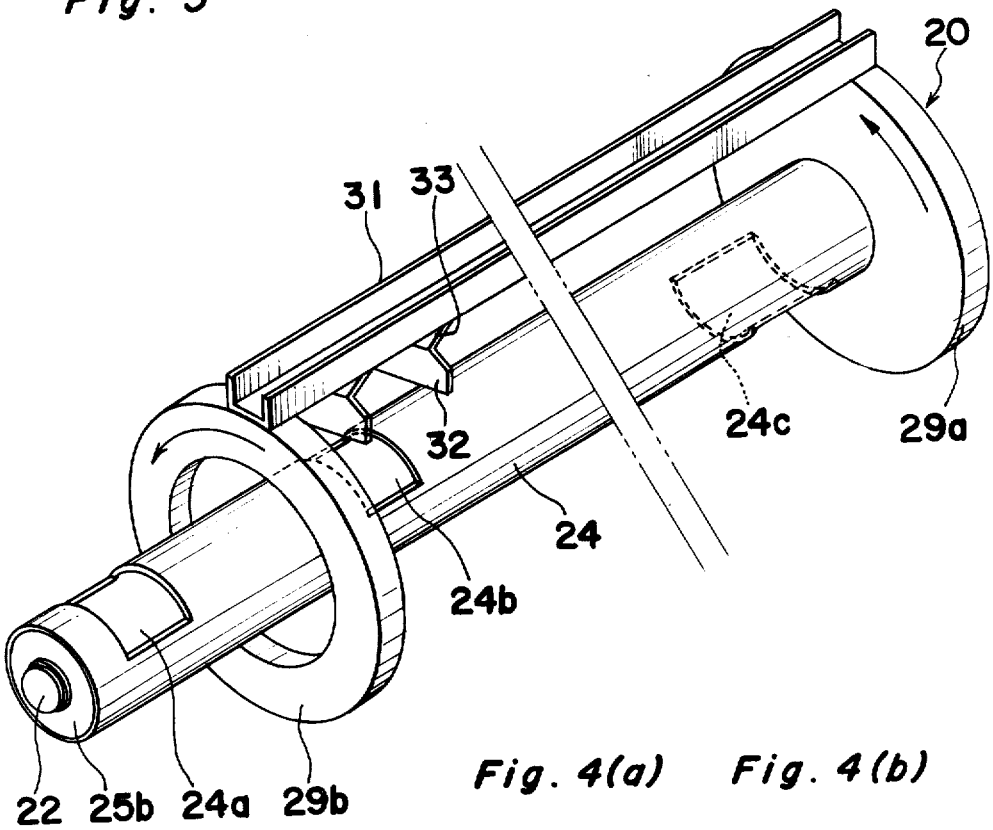
FIG. 3 is a perspective view showing, on an enlarged scale, construction of a stirring device employed in the arrangement of FIG. 1, FIG. 4(*a*) is a perspective view showing a plate-like member employed in the stirring device of FIG. 3, FIG. 4(*b*) is a fragmentary top plan view showing the attachment of the plate-like member of FIG. 4(*a*)

Referring to FIGS. 2 and 3, the developing material stirring device 20 generally includes a rotary shaft 22 extending through the developing material storage tank 21, the rotary discs 29*a* and 29*b* mounted on the shaft 22 in a manner described later, a plurality of trough-like members 31 each having a U-shaped cross section and disposed at regular intervals around the peripheral edges of the rotary discs 29*a* and 29*b* and extending parallel to shaft 22 in a paddle wheel-like configuration as shown, a plurality of plate-like members 32 secured to inner surfaces of the corresponding trough-like members 31, a cylinder member 24 coaxial with and partially surrounding the rotary shaft 22, and a coil spring 28 spirally wound around the rotary shaft 22 within the cylinder member 24 so as to function as a developing material stirring and feeding member. The rotary shaft 22 is rotatably supported at one end in a bearing 23 in one side wall 17*a* of the developing apparatus D, while the other end of the shaft 22 is also rotatably journalled in a bearing 25*b* in one end of the cylinder member 24 extending through the other side wall 17*b* of the developing apparatus D, and at the extreme end of the shaft 22 extending through the side wall 17*b*, there is secured a gear 26 for connecting the shaft 22 to a suitable driving means (not shown). The cylinder member 24 has three square openings 24*a*, 24*b* and 24*c* formed at spaced spaced intervals along the outer periphery thereof as most clearly seen in FIG. 3, and is fixedly supported by a fixed bearing 27 mounted in the side wall 17*b* and surrounding the rotary shaft 22, while the bearings 25*a* and 25*b* provided at opposite ends of the cylinder member 24 rotatably support the rotary shaft 22. The opening 24*a* is formed at the portion of the cylinder member 24 projecting out of the side wall 17*b*, i.e., on the outside of the developing apparatus D and is directed upward so as to receive fresh toner to be supplied from the toner dispenser C (FIG. 1) or used toner collected from the surface 1*a* of the photoreceptor drum 1. The other openings 24*b* and 24*c* are formed in the portion of the cylinder member 24 housed in the developing apparatus D and adjacent to the rotary discs 29*a* and 29*b* and are directed upwardly and downwardly as shown in FIG. 3. It is to be noted here that the number of the openings may be increased if desired. The coil spring 28 spirally wound around the rotary shaft 22 extends over the whole length within the interior of the cylinder member 24 and is secured at opposite ends thereof to the rotary shaft 22, and rotated simultaneously with the rotary shaft 22 upon clockwise rotation of the rotary shaft 22 in FIG. 1 so as to move the developing material in the axial direction rightward in FIG. 2, while stirring the developing material as it moves in the direction of rotation of the spring within the cylinder member 24.

The rotary disc 29*a* is fixed on the one end of the rotary shaft 22, while the other rotary disc 29*b* is rotatably supported by a bushing 30, for example of sintered metal, on the fixed bearing 27 secured in the side wall 17*b* of the developing device D, with the trough-like members 31 being disposed in spaced and parallel relation to each other parallel to the shaft 22 at regular intervals around the peripheral edges of and extending between the rotary discs 29*a* and 29*b*.

Figure 4A:
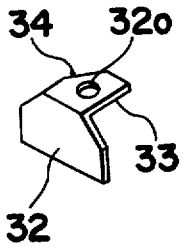
Figure 4B:
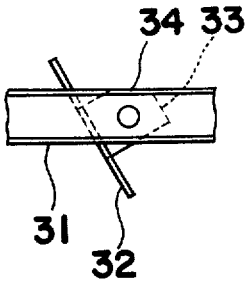
Figure 5:
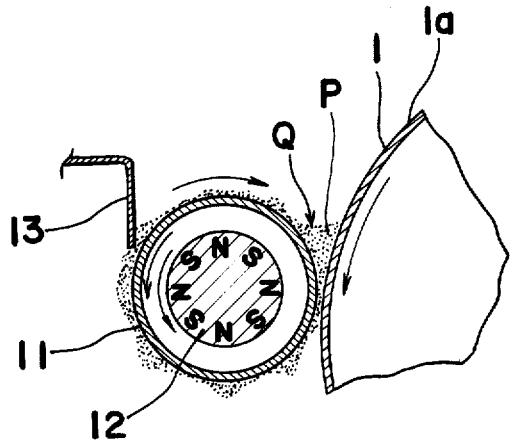
FIG. 5 is a schematic side elevational view showing on an enlarged scale the construction of a developing section employed in the arrangement of FIG. 1 and explanatory of a principle of development.

Referring to FIGS. 4(*a*) and 4(*b*), each of the plate members 32 has a bent or folded portion 33 laterally extending therefrom, and having an opening $32_0$ formed therein and a bevelled or cut-off portion 32 at its one corner. The plate members 32 are secured, by the bent portion 33 thereof, to the inner faces of diametrically opposite trough-like members 31 by screws (not shown) through the openings $32_0$ as shown in FIG. 1 in positions suitably inclined or directed slantwise with respect to the rotary shaft 22, and are simultaneously carried along as the trough-like members 31 are rotated together with the rotary discs 29*a* and 29*b* during the rotation of the rotary shaft 22 in the clockwise direction of FIG. 1 for causing the development material to move in the axial direction, i.e., in the leftward direction in FIG. 2 according to the angle of inclination set therefor, while agitating the developing material in the direction of rotation at the outside of the cylinder member 24. It is to be noted here that by securing the plate members 32 to the trough-like members 31 with the edges of the bevelled portions 34 of the bent portions 33 being aligned with the corresponding edges of the members 31 as shown in FIG. 4(*b*), the plurality of the plate members 32 can be easily secured to the trough-like members 31 at a predetermined angle of inclination.

By the above arrangement, the developing material newly supplied from the developing material supplying device C into the opening 24*a* of the cylinder member 24 is transferred rightward in FIG. 2 while being stirred within the cylinder member 24 in the direction of rotation by the coil spring 28 rotated in synchronization with the rotary shaft 22, and is led out of the cylinder member 24 through the opening 24*c* and moved leftward in FIG. 1 while being agitated in the direction of rotation at the outside of the cylinder member 24 by the plate members 22 rotating in synchronization with the rotation of the rotary shaft 22, during which time part of the developing material is scooped up by the trough-like members 31 and further transported up to the region A in FIG. 1. The developing material is carried over the peripheral surface of the developing sleeve 11 in the clockwise direction by the action of the multipolar magnet member 12 for developing the electrostatic latent image formed on the surface 1*a* of the photoreceptor drum 1 into a visible image. Meanwhile, the developing material which is not scooped up by the trough-like members 31 is moved leftward, while being stirred by the plate-members 32 so as to again enter the interior of the cylinder member through the opening 24*b*. It is to be noted here that the developing material is normally stored in the storage tank 21 up to a level B shown by the chain line in FIG. 1.

Figure 6:
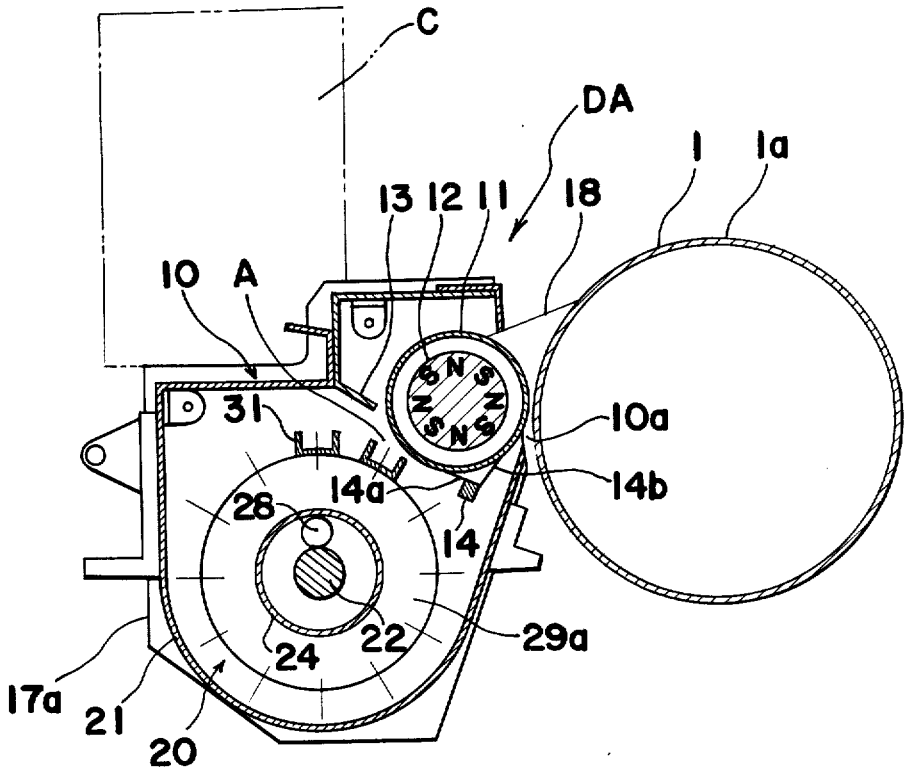
FIG. 6 is a view similar to FIG. 1, but particularly shows a modification thereof.

Referring to FIG. 6, there is shown a modification of the developing apparatus D of FIG. 1. In the modified developing apparatus DA of FIG. 6, the roll 15 described as employed in the arrangement of FIG. 1 for preventing entry of dust of toner into the interior of the copying machine is replaced by a sealing plate 18 made, for example, of polyurethane, silicone rubber, Mylar (name used in trade and manufactured by DuPont), etc., with the forward edge thereof being arranged to lightly contact the surface 1*a* of the photoreceptor drum 1. Since the remainder of the construction and function of the modified developing apparatus DA are similar to those of the developing apparatus D of FIG. 1, a detailed description thereof is omitted for brevity.

It should be noted here that although the problem concerning the increase of the torque due to generation of eddy currents the developing sleeve 11 during the high speed rotation of the multipolar magnet member 12 can be solved by the formation of the developing material collecting zone Q and broadening the developing zone by disturbing said zone Q by the rotation of the developing sleeve 11 by rotation of the multipolar magnet 12, still further favorable effects may be obtained by forming the members adjacent to the multipolar magnet member 12, for example, the scraping members 14*a* and 14*b* and doctor blade 13 of non-magnetizable and non-electrically conductive material. However, since the developing sleeve 11 must be inevitably be of electrically conductive material due to the principle of development, it is preferable that the developing sleeve 11 be made as thin as practicable to increse planar electrical resistance. Moreover, it is possible to form the base material of the photoreceptor drum by non-electrically conductive material such as synthetic resin, in which case, an electrically conductive layer, for example, of deposited metal and the like may be provided on the surface of the synthetic resin for grounding. Such a deposited layer is extremely thin and the eddy currents are not readily produced therein. It is to be noted that the developing material collecting zone Q as described above may not be formed in some cases depending on the transportation speed or transportation rate of the toner particles.

As is clear from the foregoing description, in the arrangement according to the present invention, since the developing sleeve and multipolar magnet member are rotated in the same direction, with the speed of movement of the developing material by rotation of the multipolar magnet member being set to be faster than that by the rotation of the developing sleeve, and the scraping members 14*a* and 14*b* are provided in contact the peripheral surface of the developing sleeve in the directions opposite to and the same as the direction of rotation of the developing sleeve, the developing sleeve is cleaned by the scraping member 14*a*, while the developing material is scraped off by the scraping member 14*b*, without compression of the toner between the photoreceptor and developing sleeve, and it is possible to effect favorable developing by sufficient stirring of the developing material on the developing sleeve during the rotation of said developing sleeve.

Figure 7:
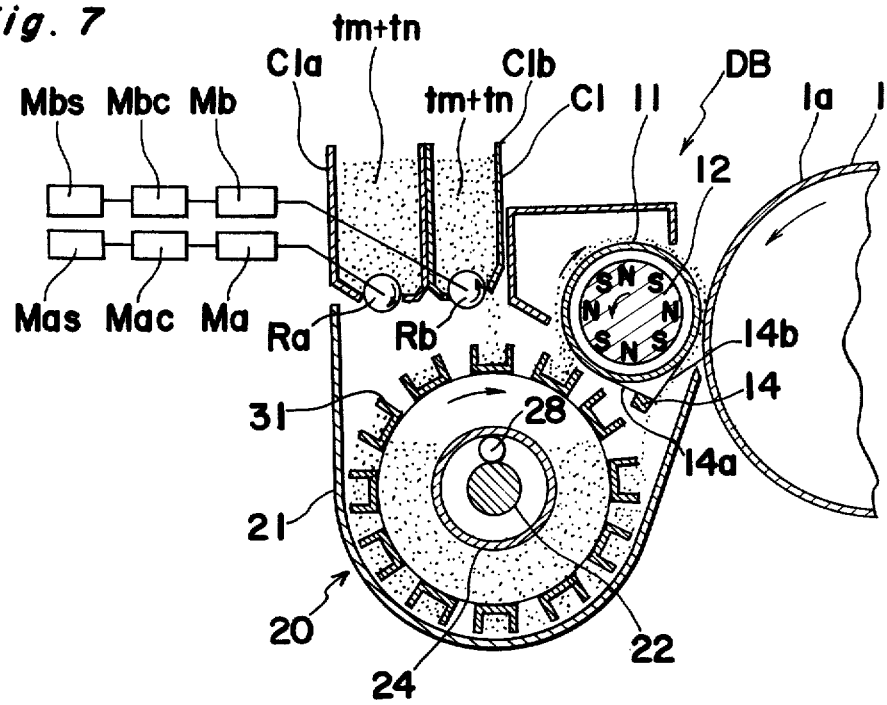
FIGS. 7 and 8 are views similar to FIG. 6, but particularly show further modifications thereof.
Figure 8:
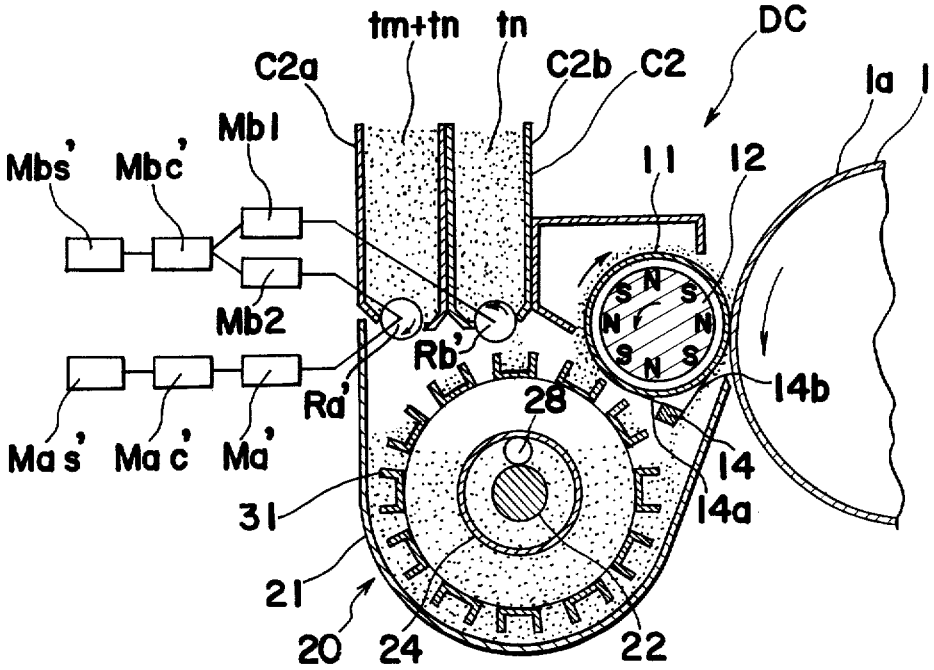

Referring to FIGS. 7 and 8, there are shown further modifications of the developing apparatus DA of FIG. 6. In these modifications, there is provided a developing material supplying device or toner dispenser which are capable of supplying the magnetizable toner and non-magnetizable toner in amounts corresponding to variations of electrostatic charge patterns to be developed.

In the modified developing apparatus DB of FIG. 7, the developing material supplying device or toner dispenser C described as provided above the developing material stirring device 20 in the arrangements of FIG. 1 and FIG. 6 is replaced by the developing material supplying device C1 which includes two containers C1*a* and C1*b*, and supplying rollers Ra and Rb rotatably provided in corresponding openings formed at the bottom of the containers C1*a* and C1*b* and respectively coupled to suitable driving means Ma and Mb for rotation. In the container C1*a*, developing material prepared by pre-mixing the magnetizable toner $t_m$ and non-magnetizable toner $t_n$ at a mixing ratio of 85 weight % is accommodated for consumption during ordinary line copying, while in the container C1*b*, developing material prepared by pre-mixing the magnetizable toner $t_m$ and non-magnetizable toner $t_n$ at a mixing ratio of 95 weight % is contained for use during solid copying. As the rollers Ra and Rb are rotated, the developing materials in the containers C1*a* and C1*b* are fed into the developing apparatus DB. The driving means Ma and Mb are further coupled respectively to control units MaC and MbC, and also to print switches MaS and MbS for actuating the control units MaC and MbC.

In the above arrangement of FIG. 7, an operator selects one of the print switches MaS or MbS for actuation, depending on the kinds of originals to be copied. For example, if the original to be copied is an ordinary line copy, various copying operations (not shown) are started upon actuation of the print switch MaS, and as the control unit MaC functions simultaneously, the supplying roller Ra provided in the container C1*a* starts rotation for feeding the developing material pre-mixed at the mixing ratio of 85 weight % into the developing apparatus DB. In the above case, it is possible to preliminarily set the amount to be supplied by proper control of the number of revolutions, duration of rotation, etc. of the supplying roller Ra by the control unit MaC and driving means Ma or to set the control unit MaC in advance so that the amount supplied will be controlled each time by detection, for example, of the difference in the sizes of the originals to be copied.

On the contrary, if the original is a solid copy having large area images, upon actuation of the print switch MbS, the control unit MbC is actuated simultaneously with the starting of the copying operations and functioning of the driving means such as the motor and the like, and thus the supplying roller Rb in the container C1*b* is rotated for feeding the developing material pre-mixed at the mixing ratio of 95 weight % into the developing apparatus DB. Regarding the amount of the developing material fed, it is possible, in a manner similar to that for the line copy described earlier, to preliminarily set the proper number of revolutions, the duration of rotation, etc. of the supplying roller Rb by means of the control unit MbC and driving means Mb or to set the driving unit Mb for controlling the amount fed each time.

As is seen from the above description, by providing the two containers D1*a* and D1*b* containing developing materials having different mixing ratios in the developing material supplying device C1 which can be selected by the operator depending on the kinds of the originals through actuation of an appropriate one of the print switches MaS or MbS, it has been made possible to feed the developing material having the desired mixing ratio, and consequently, to minimize the variation of the developing material mixing rate in the developing apparatus.

Referring now to FIG. 8, there is shown a further modification of the arrangement of FIG. 7. In the modified developing apparatus DC of FIG. 8, the developing material supplying device C1 of FIG. 7 is replaced by the developing material supplying device C2 which includes the container C2*a* containing therein the mixture of the magnetizable toner $t_m$ and non-magnetizable toner $t_n$, and the container C2*b* in which only the non-magnetizable toner $t_n$ is accommodated. For driving the supplying rollers Ra' and Rb' rotatably mounted in the openings formed at the bottom portions of the containers C2*a* and C2*b*, there are provided two systems, i.e., one system including the driving means Ma', control unit MaC', and print switch MaS' and coupled to the supplying roller Ra' for driving only said roller Ra', and the other system including the driving means Mb2 and Mb1 coupled to both of the rollers Ra' and Rb' further to the control unit MbC' and print switch MbS' for driving the supplying rollers Ra' and Rb' for the containers C2*a* and C2*b*.

In the arrangement of FIG. 8, for line copying, the print switch MaS' is actuated to supply the developing material pre-mixed at the predetermined ratio and contained in the container C2*a* into the developing apparatus DC, and for solid copying wherein the developing material having the higher mixing ratio than in the line copying is to be consumed, the print switch MbS' is actuated for supplying the developing material simultaneously from the containers C2*a* and C2*b* into the developing apparatus DC.

Since other construction and functions of the arrangements of FIGS. 7 and 8 are generally similar to those in the arrangement of FIG. 6, a detailed description thereof is omitted for brevity.

As is clear from the foregoing description, in the arrangement of FIG. 7 according to the present invention, the developing material prepared by mixing the magnetizable toner and non-magnetizable toner at the predetermined ratio is accommodated in the first container, while the developing material in which the proportion of the non-magnetizable toner is increased as compared with that of the developing material contained in the first container is accommodated in the second container for enabling the operator to select the developing material in the first container for originals which consume a less amount of the non-magnetizable toner, or the developing material in the second container for originals which may require a larger amount of the non-magnetizable toner. In the arrangement of FIG. 8, there are provided the first container containing the developing material prepared by mixing the magnetizable toner and non-magnetizable toner at the predetermined ratio and the second container containing only the non-magnetizable toner so as to supply the developing material in the first container for originals which may consume a less amount of the non-magnetizable toner, and to simultaneously supply the developing materials in the first and second containers for originals which require a larger amount of the non-magnetizable toner, by which arrangement it has been made possible to minimize the variation of the mixing ratio of the developing material in the developing apparatus.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as being included therein.

What is claimed is:

1. A dry process developing apparatus for use in an electrophotographic copying machine, comprising: a developing casing; a non-magnetizable developing sleeve rotatably mounted in said developing casing and a multipolar magnet member rotatably mounted in said developing sleeve for transporting, around the peripheral surface of the sleeve, developing material having smaller diameter particles containing magnetizable material and small diameter toner particles of non-magnetizable material for developing an electrostatic latent image formed on an image bearing member into a visible image by bringing said developing material and the electrostatic latent image into contact; means for driving said multiplier magnet member and said developing sleeve in the same direction of rotation at different speeds, the speed of rotation of said developing sleeve causing the movement of those particles of the developing material which at the most are only slightly affected by said multipolar magnet member in the direction of rotation of said developing sleeve, and the speed of rotation of said multipolar magnet causing movement of those particles of the developing material affected by said multipolar magnet member around the peripheral surface of the sleeve in a direction of rotation opposite the direction of rotation of said multipolar magnetic member and at a speed greater than the speed of said developing sleeve; and at least first and second scraper members in sliding contact with the peripheral surface of said developing sleeve, one scraper being directed in a direction for scraping off said slightly affected particles of material carried by said developing sleeve and the other scraper being directed in a direction for removing said affected particles of material carried around said developing sleeve by said multipolar magnet.

2. A dry process developing apparatus as claimed in claim 1 in which said developing casing includes a storage section for storing the developing material and means for transporting the developing material from said storage section onto said developing sleeve, and said multipolar magnet is rotated in a direction for moving said particles of developing material around the upper portion of said developing sleeve, and said scrapers are below said developing sleeve, one of said scrapers being directed in the same direction as the movement of the periphery of the developing sleeve and the other scraper being directed in the opposite direction to the direction of movement of the periphery of the developing sleeve.

3. A dry process developing apparatus as claimed in claim 6, wherein said developing casing having the developing sleeve accommodated therein includes at least a storage section for storing the developing material, means for stirring the developing material in said storage section, and means for transporting the developing material in said storage section onto said developing sleeve.

4. A dry process developing apparatus as claimed in claim 3, wherein said developing casing is further provided with means for supplying fresh developing material, said supplying means including containers for respectively storing said non-magnetizable particles and magnetizable particles separately, and supplying control means for causing said non-magnetizable particles and magnetizable particles to be independently supplied into said developing casing.

* * * * *